US007244108B2

(12) United States Patent
Kubota et al.

(10) Patent No.: US 7,244,108 B2
(45) Date of Patent: Jul. 17, 2007

(54) HERMETIC COMPRESSOR WITH AN IMPROVED CYLINDER HEAD-SUCTION MUFFLER ASSEMBLY

(75) Inventors: Akihiko Kubota, Chigasaki (JP); Hidetoshi Nishihara, Fujisawa (JP); Masahiko Osaka, Chigasaki (JP); Toshihiko Ota, Fujisawa (JP); Hiroki Awashima, Fujisawa (JP); Manabu Motegi, Koshigaya (JP); Kazuhito Noguchi, Chigasaki (JP); Takeshi Kojima, Yokohama (JP); Masahiro Kakutani, Fujisawa (JP)

(73) Assignee: Matsushita Refrigeration Company, Osaka (JP)

( * ) Notice: Subject to any disclaimer, the term of this patent is extended or adjusted under 35 U.S.C. 154(b) by 568 days.

(21) Appl. No.: 10/432,029

(22) PCT Filed: Nov. 26, 2001

(86) PCT No.: PCT/JP01/10278

§ 371 (c)(1),
(2), (4) Date: Sep. 25, 2003

(87) PCT Pub. No.: WO02/44565

PCT Pub. Date: Jun. 6, 2002

(65) Prior Publication Data

US 2004/0052653 A1 Mar. 18, 2004

(30) Foreign Application Priority Data

Nov. 29, 2000 (JP) ..... 2000-362299
Oct. 17, 2001 (JP) ..... 2001-319023

(51) Int. Cl.
*F04B 39/00* (2006.01)
*F01N 1/16* (2006.01)
*F02M 35/00* (2006.01)

(52) U.S. Cl. ..... 417/312; 181/403; 181/236; 181/229

(58) Field of Classification Search ..... 417/312; 181/403, 236, 229
See application file for complete search history.

(56) References Cited

U.S. PATENT DOCUMENTS 3,698,840 A * 10/1972 Hover ..... 417/312
3,817,661 A * 6/1974 Ingalls et al. ..... 417/312
4,523,663 A * 6/1985 Bar ..... 181/224

(Continued)

FOREIGN PATENT DOCUMENTS

JP 05149254 A * 6/1993

(Continued)

*Primary Examiner*—Anthony D. Stashick
*Assistant Examiner*—Jessica Frantz
(74) *Attorney, Agent, or Firm*—Louis Woo

(57) ABSTRACT

This invention relates to a hermetic compressor used on a refrigerant cycle such as a refrigerator, and discloses a low noise compressor designed to attenuate a resonance sound in a compression chamber and intake pressure pulsing more operatively at a position adjacent to their sources, which intake pressure pulsing occurs at an intake valve port. In the compressor, a resonance space 38 is provided adjacent to the intake valve port 29 that is closer in distance to a noise source. As a result, noise can be reduced more operatively than muffling functions of an intake muffler 31 do. In addition, although acoustic characteristics of the intake muffler 31 amplify noises having specific frequencies, such noises can be attenuated before being amplified.

8 Claims, 8 Drawing Sheets

U.S. PATENT DOCUMENTS 4,761,119 A * 8/1988 Nomura et al. ..... 417/269
4,930,995 A * 6/1990 Suzuki et al. ..... 417/312
4,960,368 A 10/1990 Lilie
5,288,212 A * 2/1994 Lee ..... 417/312
5,328,338 A * 7/1994 Hirano et al. ..... 417/312
5,443,371 A 8/1995 Calciolari
5,556,260 A * 9/1996 Takenaka et al. ..... 417/269
5,641,949 A * 6/1997 Yeo ..... 181/229
5,697,766 A * 12/1997 Oh ..... 417/312
5,775,885 A * 7/1998 Dreiman et al. ..... 417/553
5,804,777 A * 9/1998 Kim et al. ..... 181/229
5,950,307 A 9/1999 Lee
5,992,170 A * 11/1999 Yap ..... 62/296
6,129,522 A * 10/2000 Seo ..... 417/312

FOREIGN PATENT DOCUMENTS

JP 9-195936 7/1997

* cited by examiner

HERMETIC COMPRESSOR WITH AN IMPROVED CYLINDER HEAD-SUCTION MUFFLER ASSEMBLY

TECHNICAL FIELD

This invention relates to a hermetic compressor used on a refrigerant cycle such as a refrigerator.

BACKGROUND ART

In recent years, a hermetic compressor designed to run silently has highly been required. In conventional hermetic compressors, muffling functions built on an intake muffler attenuate intake pressure pulsing-caused noise. One such example of a conventional hermetic compressor is disclosed in U.S. Pat. No. 5,443,371.

The conventional hermetic compressor will now be described with reference to the drawings. FIG. 8 is a cross-sectional view, illustrating an essential portion of the compressor. In FIG. 8, reference numeral 1, 2, and 3 denote a compression element placed in a hermetic vessel, a cylinder block, and a cylinder that forms a compression chamber 4 of the compression element 1, respectively. Reference numerals 5, 6, and 7 identify a piston reciprocating in the cylinder 3, a valve plate for sealing the cylinder 3 at one end thereof, and an intake valve port formed on the valve plate 6, respectively. The intake valve port 7 is opened and closed by an intake reed 8. Reference numerals 9 and 10 designate an intake muffler and a cylinder head, respectively. The cylinder head 10 secures the valve plate 6 to the cylinder 3 at one end thereof, and further fixes the intake muffler 9 to the intake valve port 7.

A description will now be made as to how the hermetic compressor as structured above (hereinafter called a compressor) operates. A refrigerant gas returned to the compressor from the refrigerant cycle is released into the hermetic vessel. The refrigerant gas is then admitted into the compression chamber 4 through the intake muffler 9 and the intake valve port 7. The cylinder 3 and the piston 5 form the compression chamber 4. The piston 5 reciprocated by rotation of an electrically actuated element compresses the admitted refrigerant gas before the compressed refrigerant gas is fed to the refrigerant cycle through an exhaust pipe.

At this time, a resonance sound in the compression chamber 4 and intake pressure pulsing that occurs at the intake valve port 7 because of the opening/closing of the intake reed 8 are attenuated through the intake muffler 9 before being released into the hermetic vessel, thereby making it possible to reduce noise.

However, such a conventional structure as discussed above has drawbacks that the muffling functions (an expansion chamber and a resonance chamber) of the intake muffler 9 fail to provide a sufficient muffling effect because these are remote from sources such as the compression chamber 4 and the intake valve port 7, and further that acoustic characteristics of the muffler 9 for connecting the intake valve port 7 and the muffling functions together are likely to amplify noises having specific frequencies.

In order to overcome problems heretofore encountered, the present invention provides a low noise compressor designed to allow the resonance sound in the compression chamber 4 and the intake pressure pulsing occurring at the intake valve port 7 because of the opening/closing of the intake reed 8 to be dampened more operatively at a position adjacent to the sources.

Another drawback to the above conventional structure is that an arrangement of the muffling functions being positioned only within the intake muffler 9 causes the expansion chamber and the resonance chamber to be located in a limited space, thereby insufficiently combating noises having several frequencies.

DISCLOSURE OF THE INVENTION

In order to solve problems heretofore encountered, another object of the present invention is to provide a low noise compressor designed to reduce noises having more resonance frequencies.

The present invention comprises: a hermetic vessel; a compression element placed in the hermetic vessel; a cylinder block including a cylinder that forms the compression element; a valve plate including an intake valve port, the valve plate being disposed on the cylinder at an opening end thereof; a cylinder head secured to the valve plate opposite to the cylinder; an intake muffler having an outlet positioned in the cylinder head, and further having a discharge orifice provided at a distal end of the outlet and communicated to the intake valve port; a concave provided in the cylinder head; a resonance space formed by the concave being covered by the valve plate; and an elongated communicating section for communicating the outlet and the resonance space together. The communicating section is disposed on the intake muffler at the outlet thereof closer in distance to a noise source or the intake valve port, and further located opposite to the valve plate at a position where the intake muffler is accommodated in the cylinder head. The resonance space communicated to the intake valve port through the communicating section is provided. As a result, noise can be attenuated more operatively than the muffling functions of the intake muffler do. In addition, although acoustic characteristics of the intake muffler amplify noises having specific frequencies, such noises can be attenuated before being amplified.

The communicating section is positioned on the intake muffler at the outlet thereof opposite to the valve plate, while the resonance space is formed by the concave defined in the cylinder head and a surface of the valve plate opposite to the cylinder head. This construction provides an operation in that the resonance space communicated to the intake valve port through the communicating section can readily be formed without an increase in the number of components.

According to the present invention, a wall made of a synthetic resin material and integrally molded with the intake muffler at the outlet thereof forms the resonance space, and allows reduced heat to be received by the resonance space that is combined with a refrigerant gas intake passage through the communicating section. This construction provides operations in that a rise in temperature of the admitted refrigerant gas is restrained to avoid aggravating a compressor function, and that the resonance space can be formed without an increase in the number of components.

According to the present invention, the resonance space is formed by the concave provided in the cylinder head, an external wall of the intake muffler at the outlet thereof placed in the concave, and the surface of the valve plate opposite to the cylinder head. A space other than that in which the outlet of the intake muffler is placed in the concave is covered by the surface of the valve plate. This construction provides operations in that the resonance space can readily be formed without an increase in the number of components, and that the resonance space having a greater volume can be obtained in a limited area of the cylinder head, with a consequentially greater noise-attenuating effect.

According to the present invention, the communicating section between the resonance space and the intake valve port is formed by at least one cutout disposed on the intake muffler at a discharge orifice of the outlet thereof. The discharge orifice including the cutout is covered by the surface of the valve plate. This construction provides operations in that the communicating section can easily be formed without an increase in the number of components, and that a greater noise-attenuating effect is provided because the communicating section is positioned on the intake muffler at the discharge orifice thereof closer in distance to a noise source or the intake valve port.

According to the present invention, the communicating section between the resonance space and the intake valve port is formed by at least one hole provided in the intake muffler at a pipe section of the outlet thereof. This construction provides operations in that the communicating section can readily be formed without an increase in the number of components, and that a stable noise-attenuating effect is obtained because the communicating section is disposed in the intake muffler at the pipe section thereof nearer in distance to a noise source or the intake valve port, which pipe section is held in a stable acoustic mode.

According to the present invention, the communicating section between the resonance space and the intake valve port is formed by both at least one cutout disposed on the intake muffler at the discharge orifice of the outlet thereof and at least one hole provided in the intake muffler at the pipe section of the outlet thereof. As a result, the communicating section can readily be formed without an increase in the number of components, and a great and stable noise-attenuating effect is achievable. The above structure provides a further operation that a configuration of the resonance space can be selected with a wider amount of freedom.

The present invention comprises a plurality of resonance spaces. This construction provides operations in that a greater muffling effect is achievable, and further that the resonance spaces have different volumes, and can cope with noises having a plurality of frequency bands.

According to the present invention, a plurality of resonance spaces is disposed symmetrically to the communicating section. Such a symmetrical arrangement makes it possible to provide easy control over an acoustic mode node in the entire resonance of the plurality of resonance spaces that are communicated to the communicating section, in such a manner that the node is positioned on the communicating section at which a space distance is centered. This feature provides an operation that the resonance space is able to exercise a further operative noise-attenuating effect.

According to the present invention, a plurality of communicating sections communicated to the resonance space has different cross-sectional passage areas or different passage lengths. A combination of the passage area or length of the communicating section and the volume of the resonance space determines a resonance frequency. This construction provides an operation that noises having respective frequencies can be attenuated.

According to the present invention, part of a wall that forms the resonance space is provided with a minute oil draining-passage for communicating the resonance space and the hermetic vessel together in order to avoid lodging oil in the resonance space, thereby preventing the muffling capability of the resonance space from being reduced by oil accumulation. This construction provides an operation that a sufficient muffling capability can always be maintained.

BEST MODE FOR CARRYING OUT THE INVENTION

Figure 1:
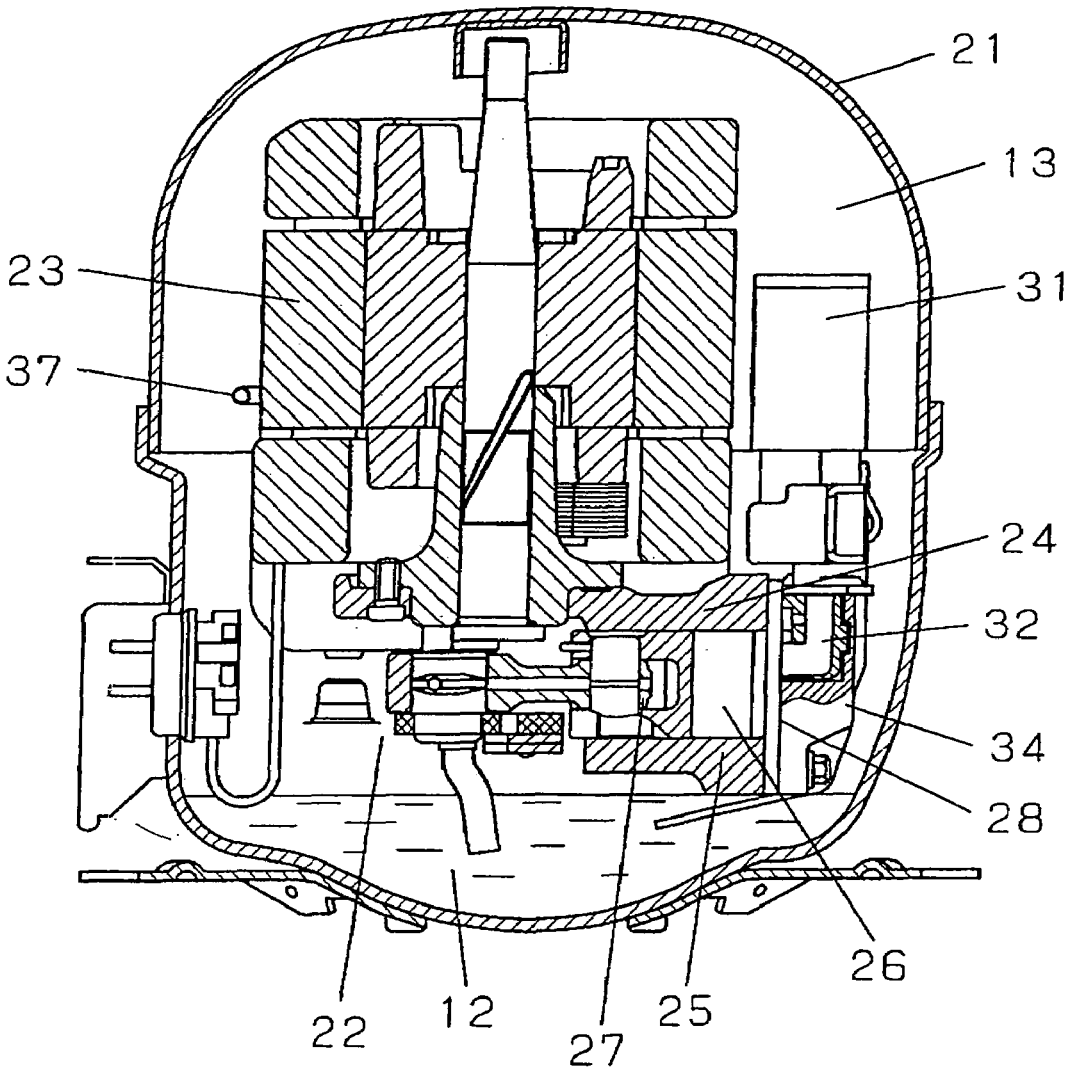
FIG. 1 is a longitudinal cross-sectional view, showing a hermetic compressor according to embodiment 1 of the present invention.

Embodiments of compressors according to the present invention will now be described with reference to the drawings. The same component elements as those in the related art are identified by the same reference characters, and detailed descriptions thereof will herein be omitted.

EMBODIMENT 1

Figure 2:
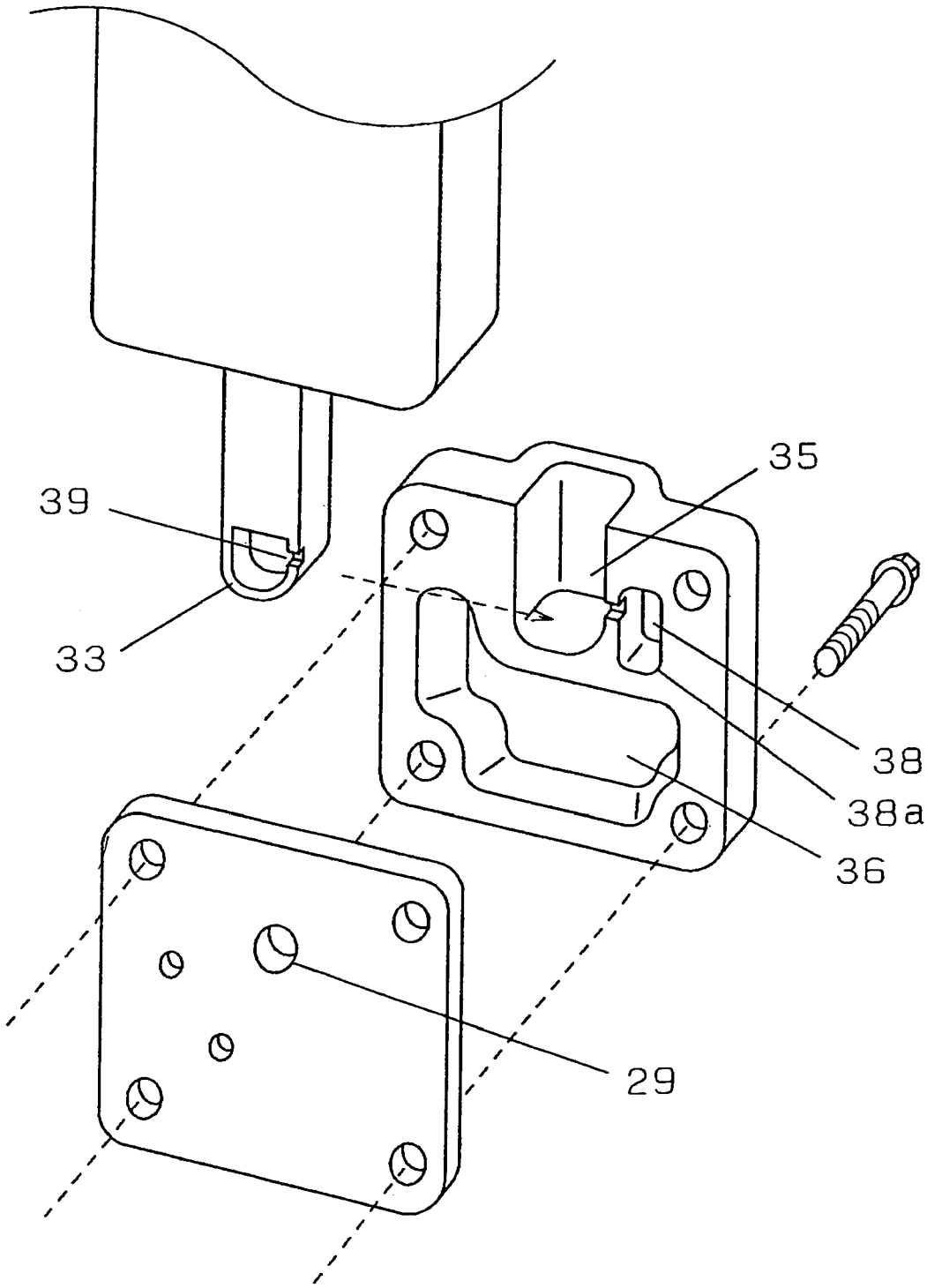
FIG. 2 is an exploded, perspective view, illustrating an essential portion of the compressor.

FIG. 1 is a longitudinal cross-sectional view, illustrating a compressor according to embodiment 1 of the present invention. FIG. 2 is an exploded, perspective view, illustrating an essential portion of the compressor. In FIGS. 1 and 2, reference numerals 21, 22, 23, and 24 denote a hermetic vessel, a compression element accommodated in the vessel 21, an electrically actuated element connected to the compression element 22, and a cylinder block, respectively. The cylinder block 24 houses a cylinder 25 that forms a compression chamber 26 of the compression element 22. Reference numerals 27, 28, and 29 identify a piston reciprocating in the cylinder 25, a valve plate for sealing the cylinder 25 at one end thereof, and an intake valve port formed on the valve plate 28. An intake reed (not shown) opens and closes the intake valve port 29.

Reference numeral 31 denotes an intake muffler for attenuating a resonance sound in the compression chamber 26 and intake pressure pulsing that occurs at the intake valve port 29 because of the opening/closing of the intake reed. In order to provide enhanced compressor performance, the intake muffler is made of, e.g., synthetic resin or a material having low thermal conductivity. In view of service environments under a refrigerant gas atmosphere and elevated temperatures, PBT (Polybutylene Terephtalate) or PPS (Polyphenylene Sulfide) may be named as preferable synthetic resin. Reference numeral 32 designates a pipe-shaped outlet of the muffler 31. The outlet 32 has a discharge orifice 33 provided at a distal end thereof.

Reference numeral 34 identifies a cylinder head that includes a concave 35, on which the intake muffler 31 is mounted, and an exhaust chamber 36. The cylinder head 34 secures the valve plate 28 to the cylinder block 24 at one end thereof, and further places the outlet 32 in the concave 35 functioning as an accommodation section, thereby pressing the discharge orifice 33 against the intake valve port 29.

Reference numerals 37, 12, and 13 indicate an exhaust pipe for connecting the compression element 22 and a refrigerant cycle together through the hermetic vessel 21, a refrigerator oil lodged in the hermetic vessel 21 at the bottom thereof, and a refrigerant gas circulated between the refrigerant cycle and the hermetic compressor, respectively. Reference numeral 38 denotes a resonance space formed by: a concave 38*a* disposed in the cylinder head 34 adjacent to the intake valve plate 29; and a surface of the valve plate 28 opposite to the cylinder head 34. The resonance space 38 is a muffler serving as a means for attenuating the resonance sound in the compression chamber 26 and the intake pressure pulsing that occurs at the intake valve port 29 because of the opening/closing of the intake reed. Reference numeral 39 designates an elongated communicating section in the form of a cutout groove. The communicating section 39 is provided on the intake muffler 31 at the discharge orifice 33 opposite to the valve plate 28 for communicating the outlet 32 and the resonance space 38 together.

A description will now be made as to how the compressor as constructed above operates. The resonance sound in the compression chamber 26 and intake pressure pulsing that occurs at the intake valve port 29 because of the opening/closing of the intake reed are attenuated in a manner described below. More specifically, the communicating section 39 is located opposite to the valve plate 28 at a position where the intake muffler 31 is placed in the cylinder head 34, and further disposed nearer to noise sources such as the compression chamber 26 and intake valve port 29, while the resonance space 38 communicated to the intake valve port 29 through the communicating section 39 is provided. This arrangement permits the resonance sound and intake pressure pulsing to be dampened by means of a noise-attenuating effect of the resonance space 38. The dampened resonance sound and intake pressure pulsing are further attenuated through the intake muffler 31 before being released into the hermetic vessel 21. As a result, the compressor according to the present invention is able to reduce noise more operatively, when compared with conventional compressors having intake mufflers simply disposed therein.

Since the intake muffler 31 has many different space distances because of its construction, noise passing through the intake muffler 31 is often amplified, depending upon a wavelength of the noise. In such a case, it is a very good way to allow the resonance space 38 to previously attenuate a sound having such a frequency.

The communicating section 39 is disposed on the intake muffler 31 opposite to the valve plate 28, while the resonance space 38 is formed by the concave 38*a* provided in the cylinder head 34 and the surface of the valve plate 28 opposite to the cylinder head 34. As a result, the resonance space 38 communicated through the communicating section 39 to the outlet that is connected to the intake valve port 29 can readily be formed without an increase in the number of components.

EMBODIMENT 2

Figure 3:
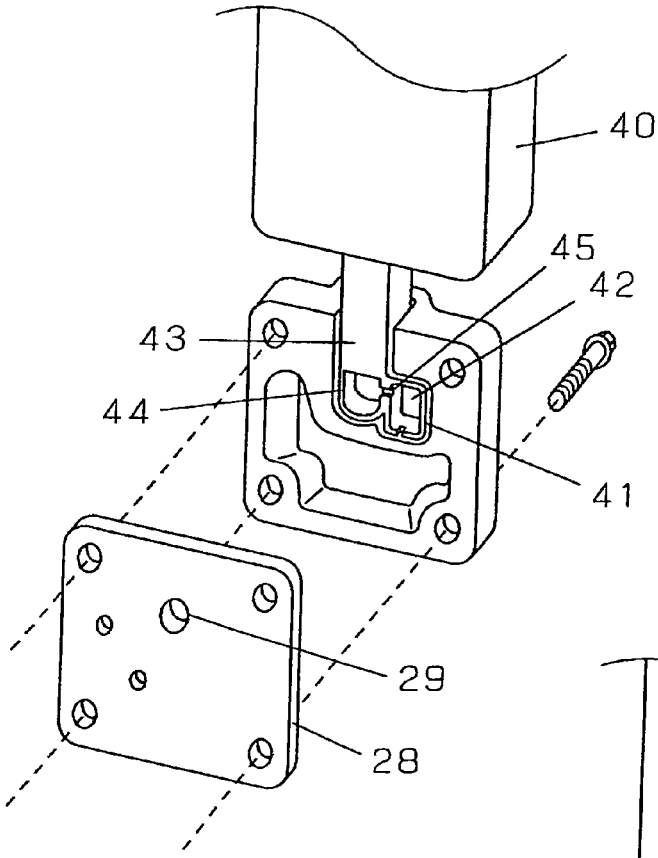
FIG. 3 is an exploded, perspective view, illustrating an essential portion of a hermetic compressor according to embodiment 2.

FIG. 3 is an exploded, perspective view, illustrating an essential portion of a compressor according to embodiment 2. In FIG. 3, reference numerals 28, 29, 40 denote a valve plate, an intake valve port, and an intake muffler, respectively. The intake muffler 40 is a silencer that acts as a means for decaying a resonance sound in the compression chamber 26 and intake pressure pulsing that occurs at the intake vale port 29 because of the opening/closing of the intake reed. In order to provide enhanced compressor performance, the intake muffler is made of, e.g., synthetic resin or a material having low thermal conductivity. In view of service environments under a refrigerant gas atmosphere and elevated temperatures, PBT or PPS may be named as preferable synthetic resin. The reference numerals 41 and 42 identify a wall made of a synthetic resin material and integrally molded with the intake muffler 40, and a resonance space formed by the wall 41 and the valve plate 28, respectively. The reference numerals 43, 44, and 45 designate an outlet, a discharge orifice or a connection of the muffler 40 to the intake valve port 29, and a communicating section or a cutout provided on the intake muffler 40 at the discharge orifice 44, respectively.

A description will be made as to how the compressor as constructed above operates. According to the embodiment 2, the wall 41 that forms the resonance space 42 is made of a material having low thermal conductivity, and is further molded integrally with the intake muffler 40. Such a construction restrains heat from being added to refrigerant gas 13 that is to be absorbed by the compression chamber 26, and forms the resonance space 42 without dramatically detracting from compressor performance. The muffling effect of the resonance space 42 allows the compressor to emit reduced noise.

Since the resonance space 42 is integrally molded with the intake muffler 40, the resonance space 42 can readily be formed without an increase in the number of components.

Since the cutout provided on the muffler 40 at the discharge orifice 44 is positioned to oppose the valve plate 28, the communicating section 45 for communicating the outlet 43 connected to the intake valve port 29 and the resonance space 42 together can readily be formed without an increase in the number of components. In addition, since the communicating section 45 is disposed closer to a noise source or the intake valve port 29, a greater noise-aftenuating effect is attainable.

EMBODIMENT 3

Figure 4:
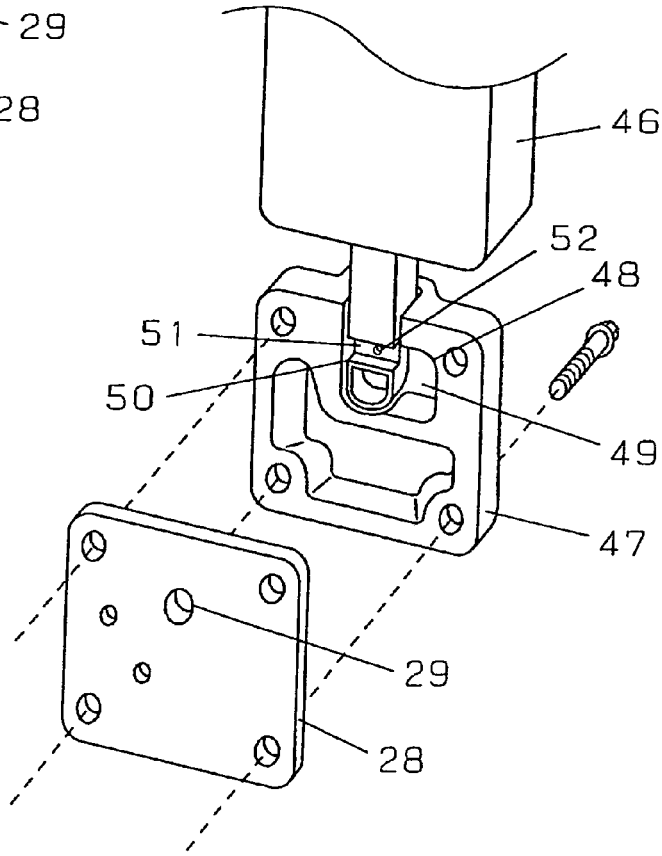
FIG. 4 is an exploded, perspective view, illustrating an essential portion of a hermetic compressor according to embodiment 3.

FIG. 4 is an exploded, perspective view, illustrating an essential portion of a compressor according to embodiment 3. In FIG. 4, reference numerals 28 and 46 denote a valve plate and an intake muffler, respectively. The intake muffler 46 is a silencer that serves as a means for attenuating a resonance sound in the compression chamber 26 and intake pressure pulsing that occurs at an intake vale port 29 because of the opening/closing of the intake reed. In order to provide enhanced compressor performance, the intake muffler is made of, e.g., synthetic resin or a material having low thermal conductivity. In view of service environments under a refrigerant gas atmosphere and elevated temperatures, PBT or PPS may be named as preferable synthetic resin. Reference numerals 47, 48, and 49 identify a cylinder head, a concave formed in the cylinder head 46, and a resonance space formed by the concave 48 and the valve plate 28, respectively. Reference numerals 50 and 52 denote an outlet of the muffler 46, which is accommodated in the cylinder head 47 and which includes a pipe section 51, and a communicating section or a hole provided in the pipe section 51, respectively.

A description will now be made as to how the compressor as constructed above operates. According to embodiment 3, part of the intake muffler 46 is placed in the concave 48, while being positioned to face a surface of the valve plate 28 opposite to the cylinder head 47. As a result, respective walls of the valve plate 28, intake muffler 46, and cylinder head 47 are possible to easily form the resonance space 49 without an increase in the number of components. In addition, it is possible to make the best use of a limited space of the cylinder head 47, thereby providing the resonance space 49 having a large volume. As a result, a greater muffling effect is achievable.

The hole provided in the intake muffler 46 at the pipe section 51 is opened to the resonance space 49. As a result, the communicating section 52 for communicating the outlet 50 connected to the intake valve port 29 and the resonance space 49 together can readily be formed without an increase in the number of components. In addition, since the simply shaped pipe section 51 in a stable acoustic mode is provided with the communicating section 52, a stable noise-attenuating effect is achievable.

EMBODIMENT 4

Figure 5A:
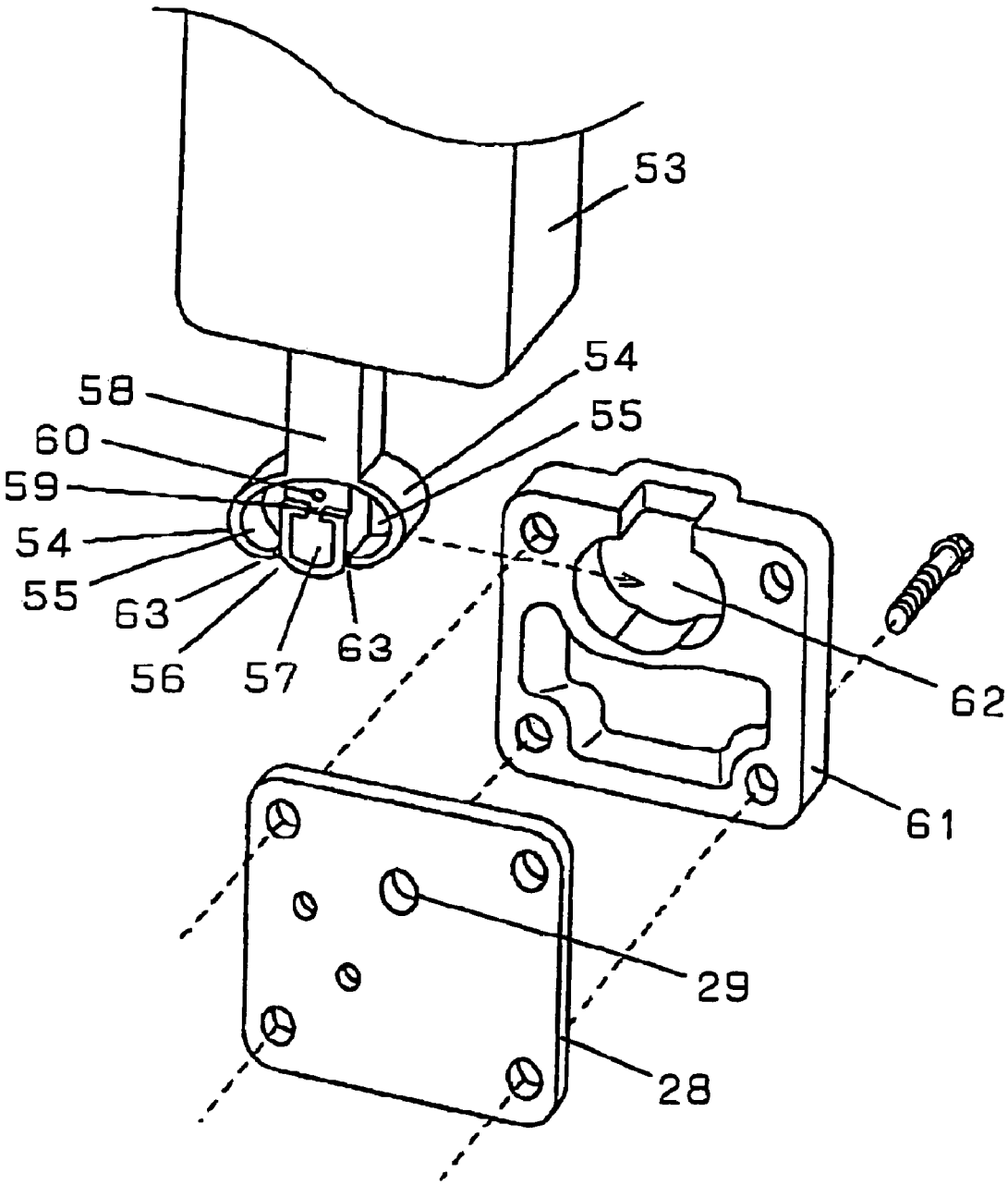
FIG. 5A is an exploded, perspective view, illustrating an essential portion of a hermetic compressor according to embodiment 4.
Figure 5B:
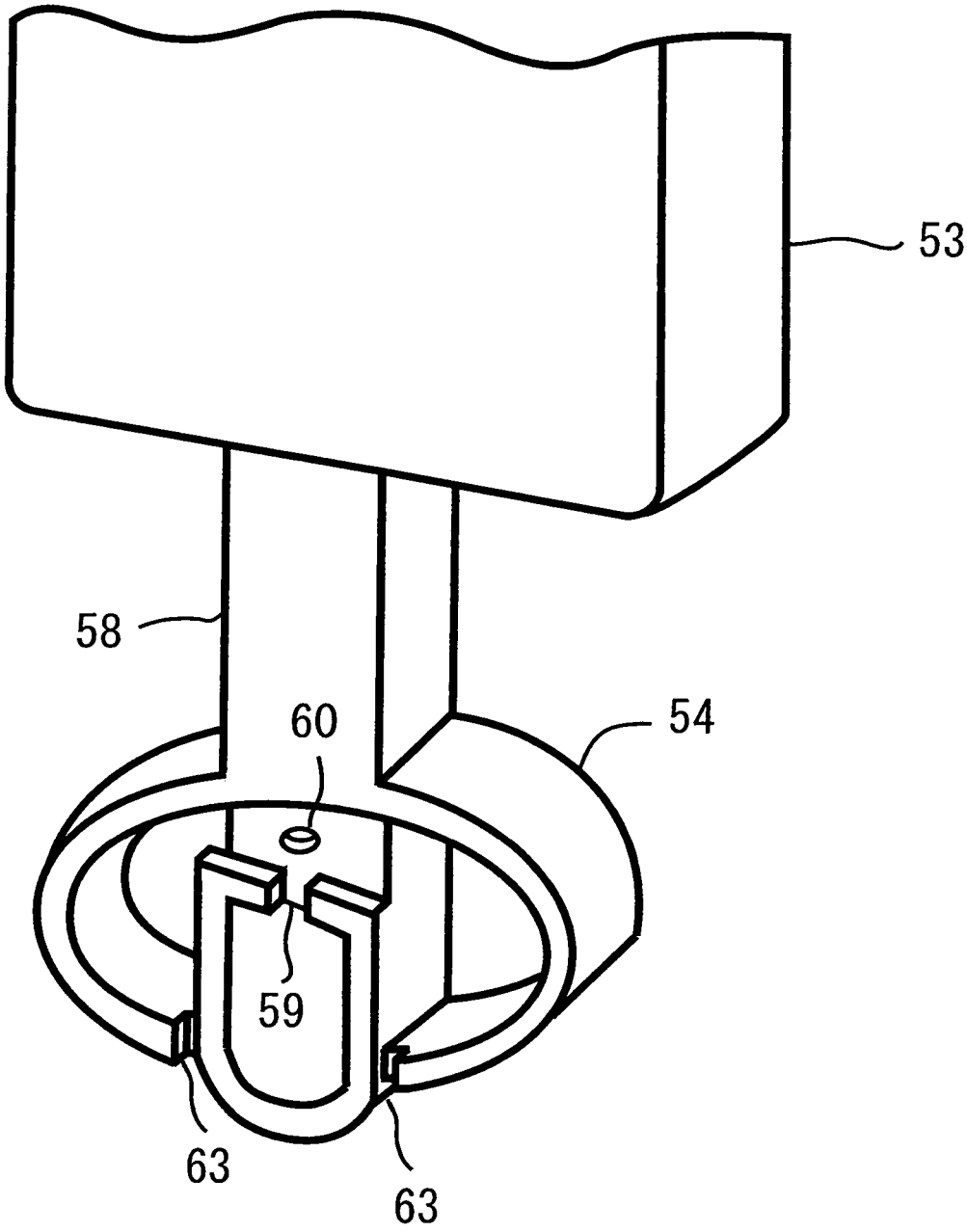
FIG. 5B is a partially enlarged illustration of FIG. 5A.
Figure 7:
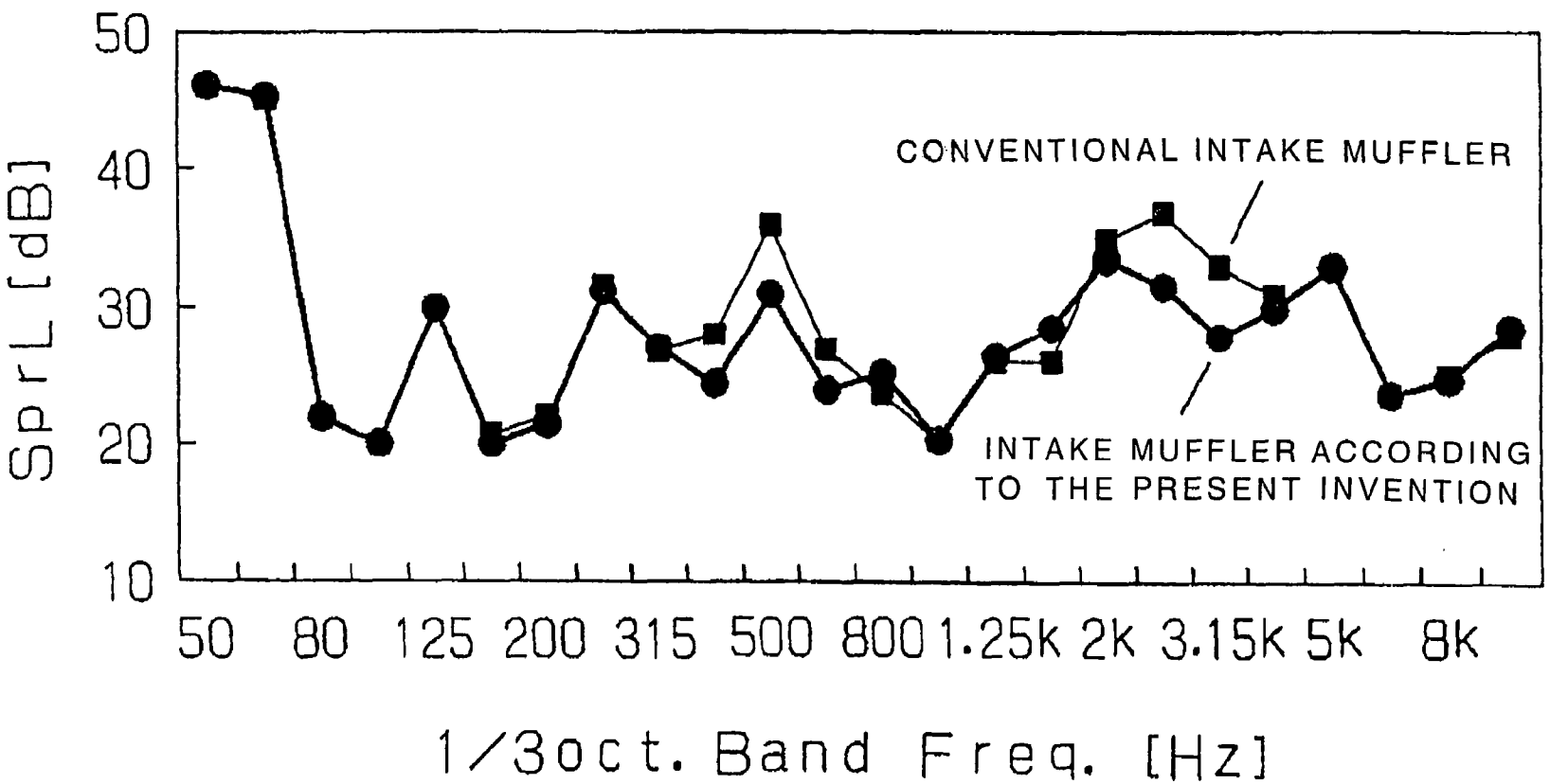
FIG. 7 is an exploded, perspective view, illustrating noise characteristics of the compressor according to embodiment 4.
Figure 8:
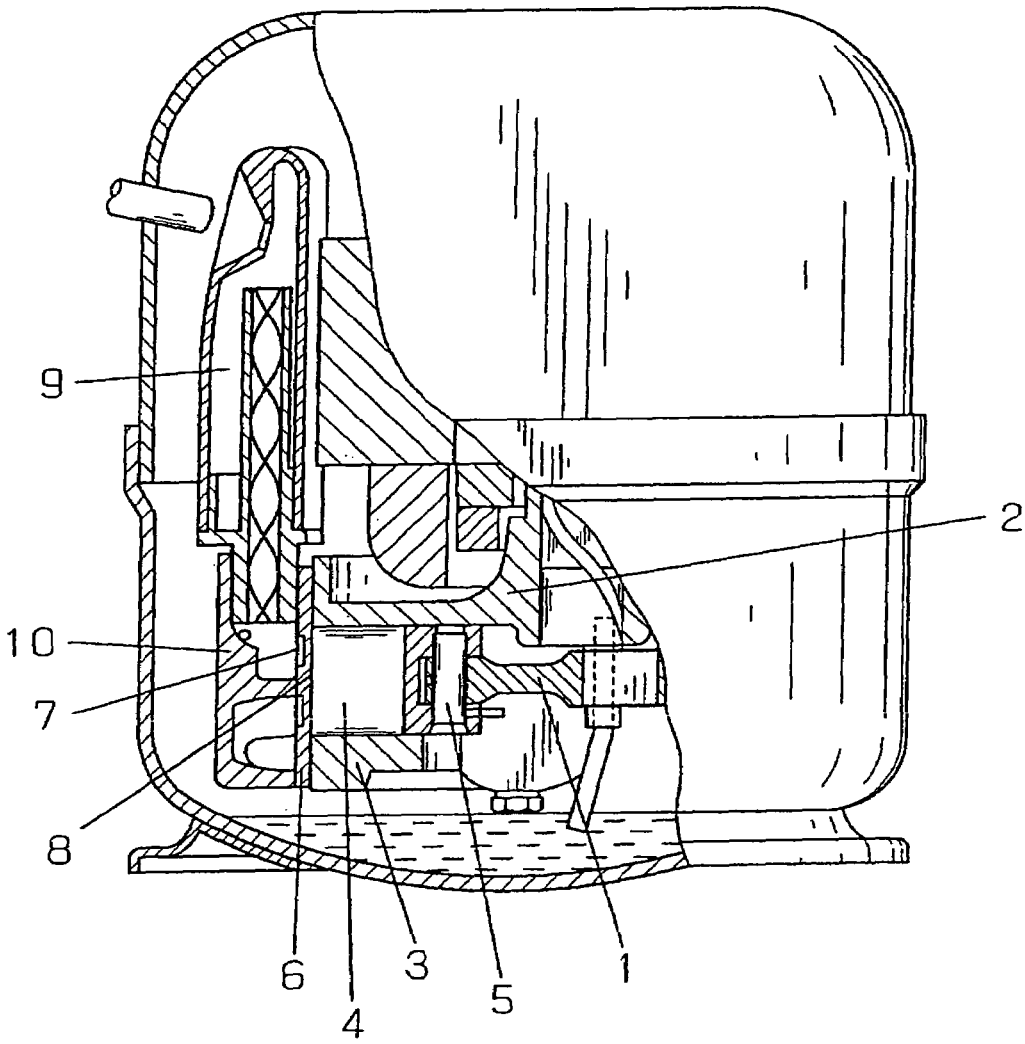
FIG. 8 PRIOR ART
FIG. 8 is a cross-sectional view, illustrating an essential portion of a conventional hermetic compressor.

FIG. 5A is an exploded, perspective view, illustrating an essential portion of a compressor according to embodiment 4. FIG. 5B is a partially enlarged illustration of FIG. 5A. FIG. 7 is a graph, illustrating noise characteristics of the compressor according to embodiment 4. In FIGS. 5A and 5B, reference numerals 28, 29, and 53 denote a valve plate, an intake valve port, and an intake muffler, respectively. The intake muffler 53 is a silencer that functions as a means for dampening a resonance sound in the compression chamber 26 and intake pressure pulsing that occurs at the intake vale port 29 because of the opening/closing of the intake reed. In order to provide enhanced compressor performance, the intake muffler is made of, e.g., synthetic resin or a material having low thermal conductivity. In view of service environments under a refrigerant gas atmosphere and elevated temperatures, PBT or PPS may be named as preferable synthetic resin. Reference numerals 54 and 55 identify walls made of a synthetic resin material and integrally molded with the intake muffler 53, and a plurality of resonance spaces formed by the walls 54 and the valve plate 28, respectively. Reference numerals 56 and 57 denote an outlet and a discharge orifice formed in the outlet 57 at a distal end thereof, respectively. The discharge orifice 57 is a connection to the intake valve port 29. Reference numerals 58, 59 denote a pipe section of the outlet 56, and a communicating section or a cutout provided in the intake muffler 53 at the discharge orifice 57 for communicating the outlet 56 connected to the intake valve port 29 and the resonance space 55 together, respectively. Reference numeral 60, 61 identify a communicating section or a hole provided in the intake muffler 53 at the pipe section 58 for communicating the outlet 56 connected to the intake valve port 29 and the resonance space 55 together, and a cylinder head, respectively. The cylinder head 61 includes a concave 62, in which the outlet 56 having the walls 54 and the pipe section 58 are disposed. The plurality of resonance spaces 55 is disposed symmetrically to the communicating sections 59, 60. Reference numeral 63 denotes an oil-draining passage having a minute cross-sectional area. The oil-draining passages 63 are provided in the walls 54 for communicating the resonance spaces 55 and the concave 62 together.

A description will now be made as to how the compressor as constructed above operates. According to embodiment 4, the communicating section 59 (cutout) provided on the intake muffler 53 at the discharge orifice 57 is positioned to face the valve plate 28, while the communicating section 60 (hole) provided in the muffler 53 at the pipe section 58 is opened to the resonance spaces 55. As a result, the outlet 56 connected to the intake valve port 29 and the resonance spaces 55 can readily be communicated together without an increase in the number of components. Since the communicating section 59 is positioned nearer to a noise source or the intake valve port 29, a greater noise-attenuating effect is achievable. In addition, since the communicating section 60 is provided in the muffler 53 at the simply shaped pipe section 58 that is held in a stable acoustic mode, a stable noise-attenuating effect is attainable.

Since the plurality of resonance spaces 55 are positioned symmetrically to the communicating sections 59 and 60, it is possible to provide easy control over an acoustic mode node in the whole resonance of the plurality of resonance spaces 55 that are communicated to the communicating sections 59 and 60, in such a manner that the node is positioned on the communicating sections 59, 60 at which space distances are centered. As a result, the resonance spaces 55 provide a further operative noise-attenuating effect.

The oil-draining passages 63 having minute cross-sectional areas are provided in part of the walls 54 for communicating the resonance spaces 55 and the concave 62 together. This construction avoids accumulating in the resonance spaces 55 through communicating sections 59, 60 a minute amount of atomized refrigerator oil 12 that is contained in the refrigerant gas 13 admitted into the compressor, and thus prevents the resonance spaces 55 from be blocked by the refrigerator oil 12. As a result, a sufficient muffling capability can be maintained.

Another operation according to embodiment 4 is that embodiment 4 can act as an expansion type of a silencer to cope with noises having frequencies other than resonance frequencies of the resonance spaces 55. More specifically, since the resonance spaces 55 are communicated to the outside of the resonance spaces 55 through the oil-draining passages 63, part of acoustic pressure occurring adjacent to the intake valve port 29 is suppressed at the communicating sections 59, 60, and is then expanded at the resonance spaces 55. The expanded acoustic pressure is then re-suppressed at the oil-draining passages 63 before being released into the outside of the resonance spaces 55. Since the acoustic pressure experiences multi-stage suppression and the oil-draining passages 63 have minute cross-sectional areas, a reduced level of acoustic pressure is released. The reminder of the acoustic pressure occurring adjacent to the intake valve port 29 is attenuated through a primary passage or the intake muffler 53 before being released into the outside. At that time, since the acoustic pressure entering the intake muffler 53 is reduced when compared with cases where no acoustic pressure is released through the oil-draining passages 63, reduced acoustic pressure is released through the intake muffler 53. As a result, the compressor is able to emit small noise.

FIG. 7 is a graph, illustrating noise characteristics of the compressor according to embodiment 4 as illustrated in FIG. 5A. The compressor according to embodiment 4 provides distinct effects when compared with compressors not employing the present embodiment.

EMBODIMENT 5

Figure 6:
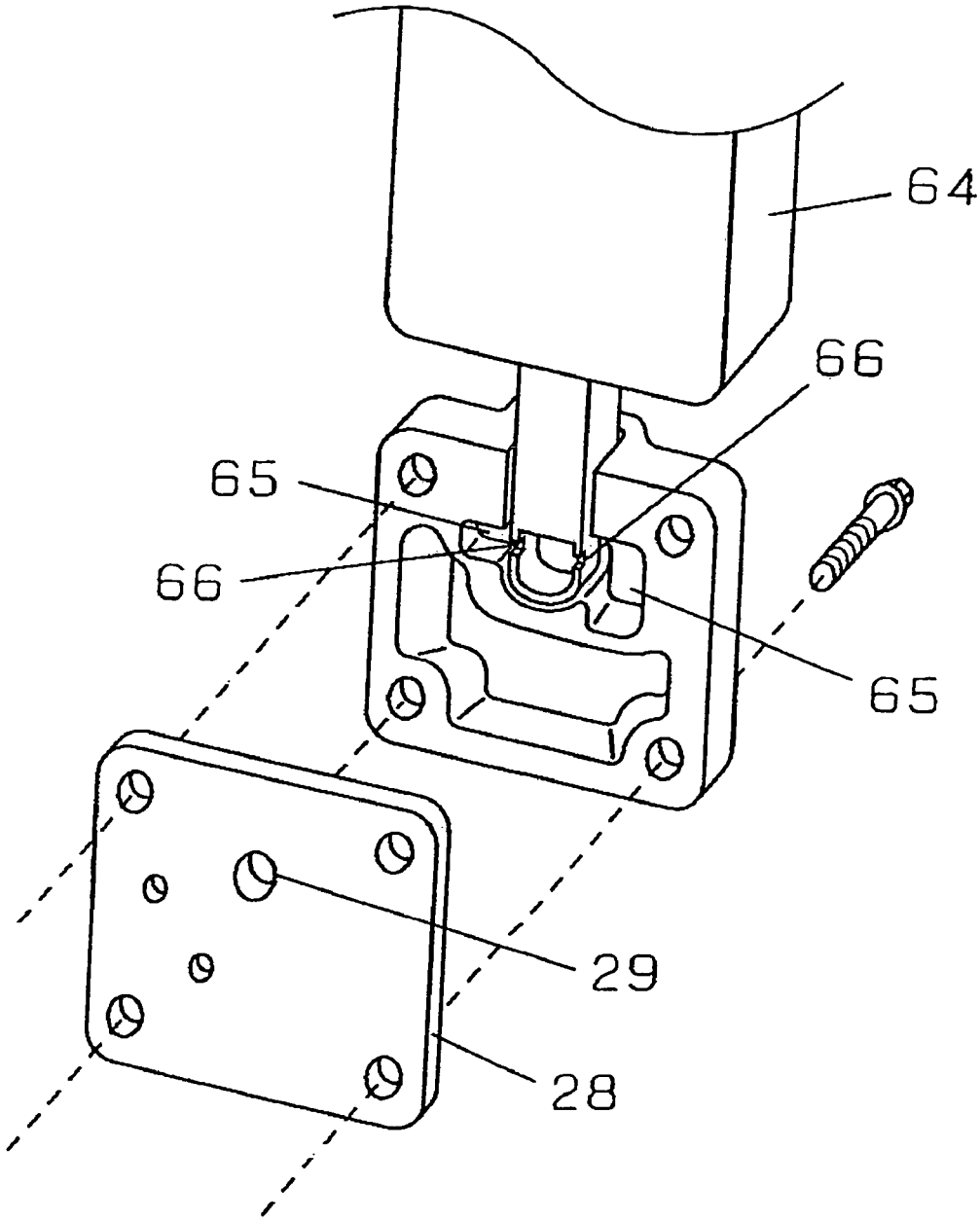
FIG. 6 is an exploded, perspective view, illustrating an essential portion of a hermetic compressor according to embodiment 5.

FIG. 6 is an exploded, perspective view, illustrating an essential portion of a compressor according to embodiment 5. In FIG. 6, reference numerals 28, 29, and 64 denote a valve plate, an intake valve port, and an intake muffler, respectively. The muffler 64 is a silencer that acts as a means for attenuating a resonance sound in the compression chamber 26 and intake pressure pulsing that occurs at the intake vale port 29 because of the opening/closing of the intake reed. In order to provide enhanced compressor performance, the intake muffler 64 is made of, e.g., synthetic resin or a material having low thermal conductivity. In view of service environments under a refrigerant gas atmosphere and elevated temperatures, PBT or PPS may be considered as preferable synthetic resin. Reference numerals 65 and 66 denote a plurality of resonance spaces and a plurality of communicating sections for communicating the intake valve port 29 and the resonance spaces 65 together, respectively.

A description will now be made as to how the compressor as constructed above operates. According to embodiment 5, the plurality of resonance spaces 65 provides a greater muffling effect. In addition, when the communicating sections 66 have the same passage cross-sectional area and passage length, then a resonance frequency reduces with an increase in volume of the resonance space 65, and vice versa. Therefore, the use of the resonance spaces 65 having different volumes makes it possible to handle noises having several frequency bands.

When the communicating sections 66 communicated to the resonance spaces 65 have different cross-sectional passage areas or different passage lengths and the resonance spaces 65 have the same volume, then the resonance frequency increases with an increase in cross-sectional area of the communicating section 66, but decreases with a decrease therein. In addition, the resonance frequency decreases with an increase in passage length, but increases with a decrease therein. Thus, a combination of the cross-sectional passage area or passage length of the communicating section 66 and the volume of the resonance space 65 determines the resonance frequency, thereby making it feasible to dampen noises having respective frequencies. As a result, noises having several frequency bands can be handled.

INDUSTRIAL APPLICABILITY

As discussed above, according to the present invention, the resonance space is disposed adjacent to the intake valve port that is nearer to a noise source, thereby making it feasible to attenuate noise more effectively than the muffling functions of the intake muffler do. In addition, although the acoustic characteristics of the intake muffler amplify noises having specific frequencies, such noises can be attenuated before being amplified. Furthermore, since the valve plate provides a surface of a wall that forms the resonance space, a concave is covered by the surface of the valve plate, thereby allowing the resonance space to be formed with ease.

According to the present invention, a wall made of a synthetic resin material and integrally molded with the intake muffler forms the resonance space, and allows reduced heat to be received by the resonance space that is combined with a refrigerant gas intake passage through the communicating section. As a result, a rise in temperature of the admitted refrigerant gas is restrained to avoid aggravating compressor performance. In addition, the resonance space can be formed without an increase in the number of components.

According to the present invention, the cylinder head, the intake muffler, and the valve plate form the resonance space. A space other than that in which the intake muffler is fitted to the concave provided in the cylinder head is covered by the surface of the valve plate. As a result, the resonance space can easily be formed without an increase in the number of components. In addition, the resonance space having a greater volume can be obtained in a limited area of the cylinder head, and a greater noise-attenuating effect is achievable.

According to the present invention, the communicating section between the resonance space and the intake valve port is formed by at least one cutout disposed on the intake muffler at a discharge orifice of an outlet thereof. The muffler outlet including the cutout is covered by the surface of the valve plate, thereby allowing the communicating section to be easily formed without an increase in the number of components. In addition, the communicating section is positioned nearer to a noise source or the intake valve port, and a greater noise-aftenuating effect is provided.

According to the present invention, the communicating section between the resonance space and the intake valve port is formed by at least one hole provided in the intake muffler at a pipe section of the outlet thereof, and can readily be formed without an increase in the number of components. In addition, the communicating section is disposed in the intake muffler at the pipe section that is held in a stable acoustic mode, and a stable noise-attenuating effect is achievable.

According to the present invention, the communicating section between the resonance space and the intake valve port is formed by both at least one cutout disposed on the intake muffler at the discharge orifice of the outlet thereof and at least one hole provided in the intake muffler at the pipe section of the outlet thereof. As a result, the communicating section can readily be formed without an increase in the number of components. In addition, a configuration of the resonance space can be selected with a wider amount of freedom. Further, a great and stable noise-attenuating effect is attainable.

The present invention comprises a plurality of resonance spaces, thereby providing a greater muffling effect. In addition, the resonance spaces have different volumes, and can handle noises having a plurality of frequency bands.

According to the present invention, a plurality of resonance spaces is disposed symmetrically to the communicating section. Such a symmetrical arrangement makes it possible to provide easy control over an acoustic mode node in the entire resonance of the plurality of resonance spaces that are communicated to the communicating section, in such a manner that the node is positioned on the communicating section at which a space distance is centered. As a result, the resonance spaces are able to exercise a further operative noise-attenuating effect.

According to the present invention, a plurality of communicating sections communicated to the resonance spaces has different cross-sectional passage areas or different passage lengths. A combination of the cross-sectional passage area or passage length of the communicating section and the volume of the resonance space determines a resonance frequency. As a result, noises having respective frequencies can be dampened.

According to the present invention, part of a wall that forms the resonance space is provided with a minute oil-draining passage for communicating the resonance space and a hermetic vessel together in order to avoid lodging oil in the resonance space, thereby preventing the muffling capability of the resonance space from being reduced by oil accumulation. As a result, a sufficient muffling ability can always be maintained.

The invention claimed is:

1. A hermetic compressor comprising:

a hermetic vessel;

a compression element placed in the hermetic vessel;

a cylinder block including a cylinder that forms the compression element;

a valve plate including an intake valve port, the valve plate being disposed on the cylinder at an opening end of the cylinder;

a cylinder head secured to the valve plate opposite to the cylinder;

an intake muffler having an outlet positioned in the cylinder head, and further having a discharge orifice located at a distal end of the outlet and opened to the intake valve port;

a concave chamber provided in the cylinder head;

a resonance space formed by the concave chamber, an external wall of said outlet of said intake muffler and the valve plate which covers said concave chamber; and an elongated communicating section for establishing communication between the outlet of said intake muffler and the resonance space, the combination of said resonance space and said elongated communicating section forming a resonance type silencer.

2. A hermetic compressor as defined in claim 1, comprising: an oil draining-passage for communicating the resonance space and the hermetic vessel together.

3. A hermetic compressor as defined in claim 1, wherein the communicating section is formed by at least one cutout provided on the intake muffler at the discharge orifice of the intake muffler.

4. A hermetic compressor as defined in claim 1, wherein the communicating section is formed by at least one hole provided in the intake muffler at a pipe section of the outlet of the intake muffler.

5. A hermetic compressor as defined in claim 1, wherein the communicating section is formed by both at least one cutout disposed on the intake muffler at the discharge orifice of the intake muffler and at least one hole provided in the intake muffler at a pipe section of the outlet of the intake muffler.

6. A hermetic compressor as defined in claim 1 or any one of claims 3-5, comprising: a plurality of the resonance spaces.

7. A hermetic compressor as defined in claim 6, wherein the resonance spaces are disposed symmetrically to the communicating section.

8. A hermetic compressor as defined in claim 6, wherein a plurality of the communicating sections has either one of different cross-sectional passage areas and different passage lengths.

* * * * *